US005169347A

United States Patent [19]

Sang

[11] Patent Number: 5,169,347

[45] Date of Patent: Dec. 8, 1992

[54] SLIP-OFF ELECTRICAL CONNECTOR HEADER

[75] Inventor: Lai M. Sang, Singapore, Singapore

[73] Assignee: Molex Incorporated, Lisle, Ill.

[21] Appl. No.: 777,830

[22] Filed: Oct. 15, 1991

[51] Int. Cl.[5] ..... H01R 13/00

[52] U.S. Cl. ..... 439/885; 29/739; 29/759; 29/845

[58] Field of Search ..... 439/83, 444, 733, 876, 439/885; 29/739, 759, 842, 845

[56] References Cited

U.S. PATENT DOCUMENTS

| | | | |
|---|---|---|---|
| 3,545,606 | 12/1970 | Bennett | 29/739 |
| 4,061,405 | 12/1977 | Minter | 439/83 |
| 4,475,284 | 10/1984 | Johnson | 29/739 |
| 4,655,517 | 4/1987 | Bryce | 439/83 |
| 5,076,796 | 12/1991 | Kusayanagi et al. | 439/876 |

*Primary Examiner*—Joseph H. McGlynn
*Attorney, Agent, or Firm*—Charles S. Cohen

[57] ABSTRACT

A header assembly includes an insulating block having a given thickness and a plurality of pin-receiving passages therethrough. A plurality of terminal pins are received in the passages and project from the insulator block for insertion into holes in a printed circuit board and for solder connection to circuit traces on the circuit board. The terminal pins are interference-fit in the passages in the insulator block to allow the block to be slid off the pins after soldering to the printed circuit board. The area of the inference-fit between the terminal pins and the pin-receiving passages is less than the thickness of the insulator block to reduce the amount of force required to slide the block off of the pins while affording the block to be of a substantial thickness. The pin-receiving passages are provided with chamfered mouths to facilitate insertion of terminal pins into the passages. A flange projects outwardly from the top of the insulator block to facilitate gripping the block and sliding the block off the terminal pins.

11 Claims, 2 Drawing Sheets

SLIP-OFF ELECTRICAL CONNECTOR HEADER

FIELD OF THE INVENTION

This invention generally relates to the art of electrical connectors and, particularly, to a header which is slipped or slid off of terminal pins after the pins are soldered to a printed circuit board.

BACKGROUND OF THE INVENTION

With the continuing trend toward compact electronic machines or apparatus, there is an ever increasing demand for miniaturized interconnection systems between the electronic components of the apparatus. An example is in disk drives for computer apparatus wherein there is a constant demand to reduce the thickness or height parameters of the disk drives. With the components mounted on a printed circuit board, the thickness or height parameters relate to the distance above the board in which desired interconnections are made and which constantly are being miniaturized.

One approach to such miniaturization is to completely eliminate the insulating header which mounts terminal pins in the printed circuit board as opposed to the header being a permanent fixture mounting the pins. Such "slip-off" header blocks have been used for locating or inserting the terminal pins into appropriate holes in the printed circuit board. The pins then are soldered to circuit traces on the board or in the holes, and the header block is slid off of the pins, whereby a complementary connector assembly is mounted directly onto the pins projecting from the board.

Various problems have been encountered in utilizing slip-off header blocks of the character described above. Most of the problems revolve around the dilemma of providing a sufficiently large header block which can provide stability for the pins during the insertion of the pins into the printed circuit board yet still permitting the header block to be removed from the pins in an efficient manner without damaging the pins or the solder connections between the pins and the circuit traces on the printed circuit board.

This invention is directed to solving the above problems by providing an improved slip-off header for locating and interconnecting terminal pins in appropriate holes in a printed circuit board.

SUMMARY OF THE INVENTION

An object, therefore, of the invention is to provide a new and improved header assembly for permanently mounting terminal pins to a printed circuit board, with a header block of the assembly being readily removable from the pins after the pins are soldered to the board.

In the exemplary embodiment of the invention, the header assembly includes an insulator block having a given thickness and a plurality of pin-receiving passages therethrough. A plurality of terminal pins are received in the passages and project from the insulator block for insertion into holes in a printed circuit board and for solder connection to circuit traces on the board. The terminal pins are interference-fit in the passages in the insulator block to allow the block to be slid off the pins after soldering to the printed circuit board. The invention contemplates that the area of the interference-fit between the terminal pins and the pin-receiving passages be less than the thickness of the insulator block. This reduces the amount of force required to slide the block off the pins while still affording the block to be sufficiently rigid to maintain the alignment of the pins yet still facilitating easy removal of the block from the pins.

Another feature of the invention is the provision of gripping means on the outside of the insulator block to facilitate sliding the block off the terminal pins. In the exemplary embodiment of the invention, the gripping means is provided in the form of an integral flange projecting outwardly from opposite sides of the insulator block, near the top thereof.

A further feature of the invention is the provision of a chamfered mouth at the pin-inserting entrance of each pin-receiving passage to facilitate insertion of a terminal pin into the passage.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
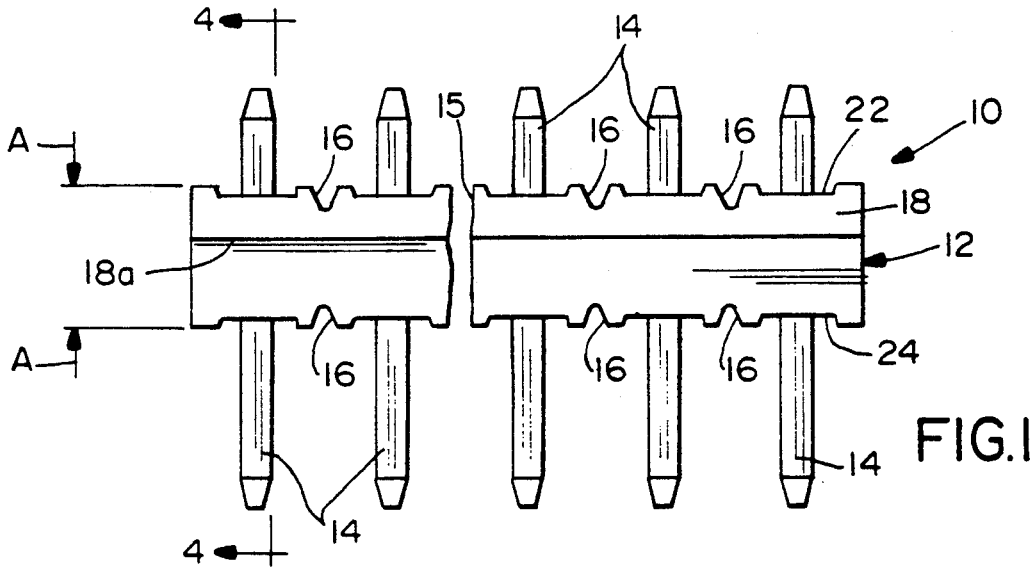
FIG. 1 is a side elevational view of a header assembly embodying the concepts of the invention.
Figure 2:
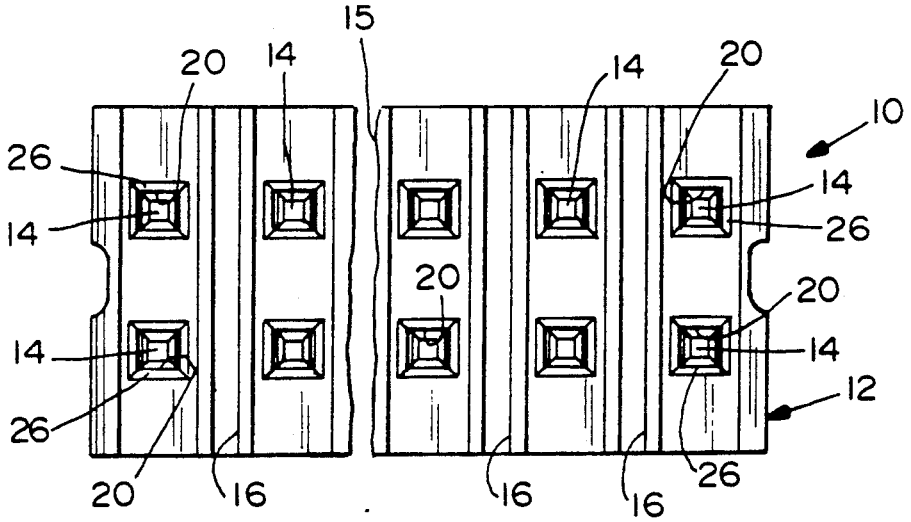
FIG. 2 is a top plan view of the header assembly.
Figure 3:
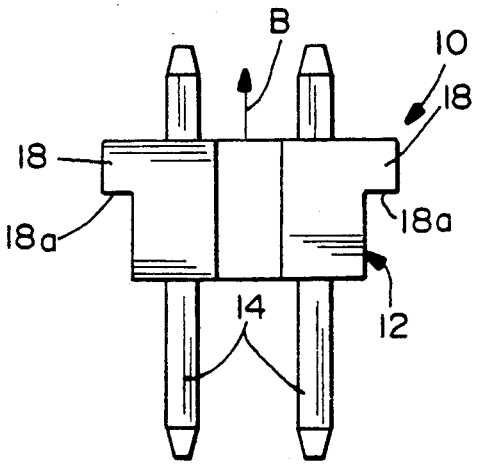
FIG. 3 is an end elevational view of the header assembly.

Referring to the drawings in greater detail, and first to FIGS. 1-3, the invention is embodied in a header assembly, generally designated 10, which includes an insulator block, generally designated 12, having a given thickness indicated by arrows "A" (FIG. 1), and a plurality of terminal pins 14 received in passages 20 (described hereinafter) in the insulator block. The first illustrated embodiment includes two rows of terminals pins in the insulator block but could include any desired number. To exemplify the miniaturization to which the invention is directed, the pins are spaced apart 2.0 mm in each row, the rows are spaced 2.0 mm apart and each terminal pin is 0.50 mm in cross-dimensions such as the square pins shown.

Insulator block 12 is unitarily molded of dielectric material such as plastic, or the like, and may be fabricated in a length which is longer than a desired length for a particular interconnection use. Specifically, insulator block 12 is shown in FIGS. 1 and 2 as being broken away at 15, representing that the block can be of a considerably greater length. Break-off grooves 16 are provided whereby the block, either before or after terminal pins 14 are mounted therein, can be broken into a particular length having a particular number of terminal pins for a particular interconnection application.

Generally, insulator block 12 is provided with gripping means on the outside thereof to facilitate sliding the block off of terminal pins 14, as described hereinafter. Specifically, referring to FIG. 3, the insulator block is provided with integral side flanges 18 projecting outwardly therefrom at the top thereof. The flanges define shoulders 18*a* on the underside thereof and under which gripping forces can be applied to lift the block off of terminal pins 14 in the direction of arrow "B".

Figure 4:
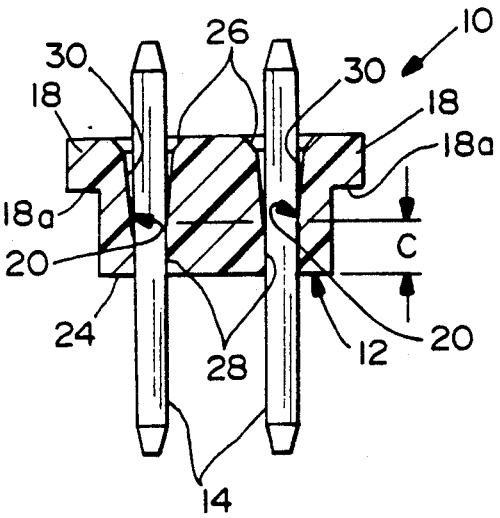
FIG. 4 is a vertical section, on an enlarged scale and with the terminal pins in elevation, taken generally along line 4—4 of FIG. 1.

Referring to FIG. 4, insulator block 12 is provided with a plurality of pin-receiving passages, generally designated 20, through the insulator block and extending between a top surface 22 and a bottom surface 24 of the block. Terminal pins 14 are inserted from the top into the through passages so that the pins project from bottom surface 24 for insertion into holes in a printed circuit board (not shown) and for solder connection to circuit traces on the board or in the holes.

Each pin-receiving passage 20 is divided into three sections or areas, namely: a chamfered top area 26, a bottom interference-fit area 28 and a tapered area 30 between the top chamfered area and the bottom interference-fit area. Thus, it is clear that the block 12 is thicker than the portion of the block that contacts the pins 14. As a result, a relatively thick block can be used which maintains the alignment of the pins to facilitate alignment and insertion with the appropriate holes in the printed circuit board yet still permit removal of the block after soldering.

Top chamfered area 26 of each pin-receiving passage 20 is provided to define an enlarged mouth to facilitate inserting a pin into the respective passage during the manufacturing process. Tapered area 30 is provided for centering the pin upon further insertion of the pin into the passage. Interference-fit area 28 is provided to establish an interference-fit with the terminal pin so that all of the terminal pins can be inserted into the holes in the printed circuit board by means of manipulating the insulator block, and thereafter to allow the block to be slid off the pins after the pins are soldered to the printed circuit board.

Still referring to FIG. 4, the invention contemplates that interference-fit areas 28 between terminal pins 14 and the insulator block within pin-receiving passages 20 be less than the thickness "A" (FIG. 1) to reduce the amount of force required to slide the block off of the pins while still affording the block to be of a substantial thickness or size. In other words, if the insulator block were only as thick as the interference-fit area 28, as indicated by double-headed arrows "C" (FIG. 4), the insulator block would be too thin to provide flanges 18 having any rigidity and would likely be so flexible as to make alignment of all of the pins during insertion into the printed circuit board somewhat difficult.

On the other hand, if interference-fit area 28 extended the entire or substantially the entire extent of pin-receiving passages 20, relatively large forces would be required to slide the insulator block off of the terminal pins which could damage the pins or the solder connections between the pins and the circuit traces on the printed circuit board. These forces can become considerable in a header assembly wherein a considerable number of terminal pins are required in the two rows thereof for a given multiple interconnection application. Therefore, the design of the through passages in the insulator block, according to the invention, enables a relatively rigid insulator block to be employed to fully protect the terminal pins, to allow for the provision of gripping means such as flanges 18, and still reduce the amount of force required to remove the insulator block from the pins.

Figure 5:
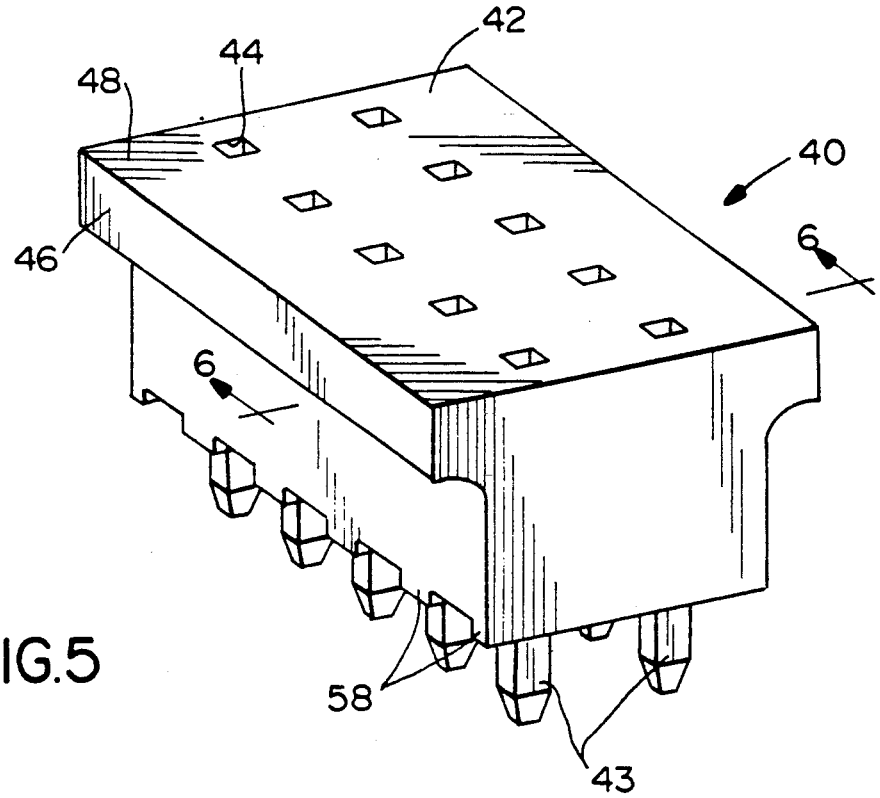
FIG. 5 is a perspective view of an alternative embodiment of the present invention.
Figure 6:
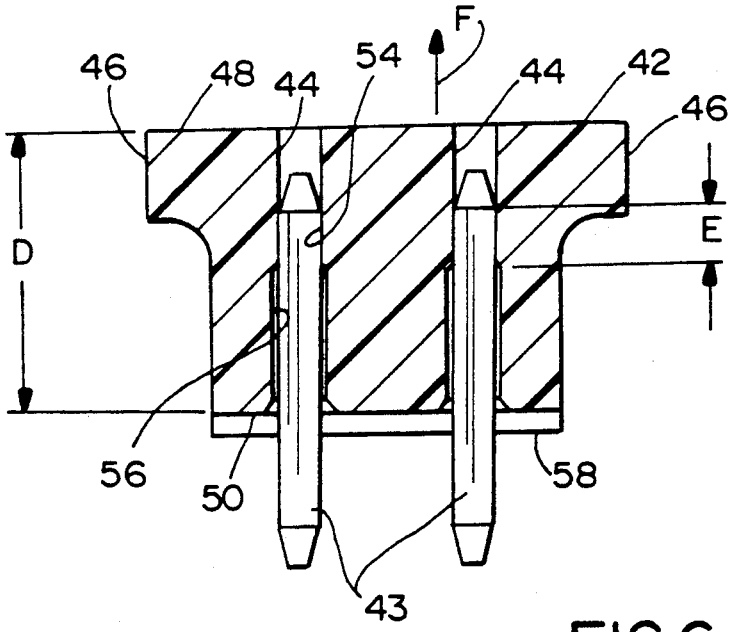
FIG. 6 is a vertical section, on an enlarged scale and with the terminal pins in elevation, taken generally along line 6—6 of FIG. 5.

Referring now to FIGS. 5 and 6, an alternative embodiment of the present invention is shown. The header assembly, generally designated 40, includes an insulator block 42 having a given thickness "D" and a plurality of terminal pins 43 received in passages 44 in the insulator block. The insulator block 42 is provided with integral side flanges 46 that are similar to those shown in FIGS. 1–4 and serve the same purpose. Insulator block 42 is not shown as having break-off grooves, but such grooves could be provided if desired.

As with the pin-receiving passages 20 of FIG. 4, the pin-receiving cavities 44 of FIGS. 5 and 6 also extend between the top surface 48 and the bottom surface 50 of the block and such passages are similarly divided into three sections. The terminal pins 14 are inserted from the bottom into the through passages 44. Each pin-receiving passage 44 includes a chamfered bottom area 52, a top interference-fit area 54 and a clearance area 56 in which the pin does not contact the passage between the chamfered bottom area and the top interference area. The width of top interference-fit area 54 is designated as "E" and is substantially less than the thickness of block 42 which is designated "D".

The use of header assembly 40 is identical to that of header assembly 10 except that the pins are inserted into the passages 44 in insulator block 42 from the bottom past bottom surface 50. Insulator block 42 also includes stand-offs 58 for raising the insulator block 42 above the printed circuit board (not shown) to which the terminal pins 43 are soldered. After the pins are soldered to the board, block 42 is removed by grasping flanges 46 and sliding the block upwards in the direction "F".

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A slip-off header assembly for temporarily retaining terminals pins in a predetermined array therein until said pins are secured to a printed circuit board, said header assembly including an insulator block having a given generally uniform thickness and a plurality of pin-receiving passages therethrough, a plurality of terminal pins received in the passages and having end portions projecting from the insulator block for insertion into holes in a printed circuit board and for solder connection to circuit traces on the board, the terminal pins being interference-fit in the passages in the insulator block to allow the block to be slid off the pins after soldering to the printed circuit board, wherein the improvement comprises said given thickness of said insulator block being sufficient so that said block is relatively stiff to maintain the end portions of the terminal pins in said predetermined array and the length of the interference-fit between the terminal pins and the pin-receiving passages being equal to or less than one half the thickness of the insulator block to reduce the amount of force required to slide the block off the pins while affording the block to be of a substantial thickness.

2. The header assembly of claim 1 wherein each of said pin-receiving passages is provided with a chamfered mouth to facilitate insertion of a terminal pin into the passage.

3. The header assembly of claim 1 including gripping means on the outside of the insulator block to facilitate sliding the block off the terminals pins.

4. The header assembly of claim 3 wherein said gripping means comprises an integral flange projecting outwardly from opposite sides of the insulator block.

5. The header assembly of claim 4 wherein the length of interference between said pins and said passages is substantially less than said given thickness.

6. A slip-off header assembly for temporarily retaining terminals pins in a predetermined array therein until said pins are secured to a printed circuit board, said header assembly including an insulator block having a given thickness between a top surface and bottom surface thereof and including a plurality of pin-receiving passages therethrough, a plurality of terminal pins received in the passages and having end portions projecting from the bottom surface of the insulator block for insertion into holes in a printed circuit board and for solder connection to circuit traces on the board, and the terminal pins being interference-fit in the passages so that said pin can be inserted into a hole in the printed circuit board yet allow the insulator block to be slid off the pins after soldering thereof to the printed circuit board, wherein the improvement comprises said given thickness of said insulator block being sufficient so that said block is relatively stiff to maintain the end portions of the terminal pins in said predetermined array and each pin receiving a passage including a chamfered area in the bottom surface of the insulator block defining an entrance to the passage to facilitate insertion of a terminal pin into the passage, a clearance area adjacent said chamfered area and extending towards said top surface of said housing, said clearance area being dimensioned so as not to engage a pin inserted into said passage in a manner to significantly increase a force required to slip said housing off of said pins, and an upper interference-fit area adjacent said clearance area and extending towards said top surface of said housing and into which a respective terminal pin is interference-fit, the length of the interference-fit between the terminal pins and the pin-receiving passages being equal to or less than one half the thickness of the insulator block to reduce the amount of force required to slide the block off the pins.

7. The header assembly of claim 6 including gripping means on the outside of the insulator block to facilitate sliding the block off the terminal pins.

8. The header assembly of claim 7 wherein said gripping means comprises an integral outwardly from opposite sides of the insulator block adjacent the top surface thereof.

9. A slip-off header assembly for temporarily retaining terminals pins in a predetermined array therein until said pins are secured to a printed circuit board, said header assembly including an insulator block having a given, generally uniform thickness and a plurality of pin-receiving passages therethrough, a plurality of terminal pins received in the passages and having end portions projecting from the insulator block for insertion into holes in a printed circuit board and for solder connection to circuit traces on the board, the terminal pins being interference-fit in the passages in the insulator block to allow the block to be slid off the pins after soldering to the printed circuit board, wherein the improvement comprises said given thickness of said insulator block being sufficient so that said block is relatively stiff to maintain the end portions of the terminal pins in said predetermined array, the length of the interference-fit between the terminal pins and the pin-receiving passages being equal to or less than one half the thickness of the insulator block to reduce the amount of force required to slide the block off the pins while affording the block to be of a substantial thickness and said insulator block having an integral flange projecting from opposite sides thereof to facilitate sliding the block off the terminal pins.

10. The header assembly of claim 9 wherein each of said pin-receiving passages is provided with a chamfered mouth to facilitate insertion of a terminal pin into the passage.

11. The header assembly of claim 10 wherein the length of interference between the pins and the passages is substantially less than said given thickness.

* * * * *